US007963764B2

(12) United States Patent
Brautsch et al.

(10) Patent No.: US 7,963,764 B2
(45) Date of Patent: Jun. 21, 2011

(54) HYBRID BURNER LANCE

(75) Inventors: Andreas Brautsch, Wuerenlingen (CH); Hanspeter Hardegger, Nuerensdorf (CH); Daniel Burri, Rothenburg (CH); Bettina Paikert, Oberrohrdorf (CH)

(73) Assignee: Alstom Technology Ltd, Baden (CH)

( * ) Notice: Subject to any disclaimer, the term of this patent is extended or adjusted under 35 U.S.C. 154(b) by 200 days.

(21) Appl. No.: 11/678,182

(22) Filed: Feb. 23, 2007

(65) Prior Publication Data

US 2007/0207425 A1 Sep. 6, 2007

Related U.S. Application Data

(63) Continuation of application No. PCT/EP2005/054073, filed on Aug. 18, 2005.

(30) Foreign Application Priority Data

Aug. 23, 2004 (DE) ..... 10 2004 041 272

(51) Int. Cl.
*F23C 5/00* (2006.01)
*F23M 3/02* (2006.01)

(52) U.S. Cl. ..... 431/8; 431/159; 431/187; 60/742; 239/423; 239/424

(58) Field of Classification Search ..... 239/398, 239/416.5, 418, 423, 424, 424.5, 425, 533.2, 239/422, 416.4, 434; 431/8, 159, 181, 187, 431/354, 346; 60/742, 746
See application file for complete search history.

(56) References Cited

U.S. PATENT DOCUMENTS

| | | | | | |
|---|---|---|---|---|---|
| 1,512,132 | A | * | 10/1924 | Pfahl | 239/416.3 |
| 1,950,044 | A | * | 3/1934 | Wilson | 431/8 |
| 3,061,001 | A | * | 10/1962 | Reed | 431/349 |
| 3,460,915 | A | * | 8/1969 | Lehrer et al. | 422/224 |
| 3,468,487 | A | * | 9/1969 | Warren | 239/403 |
| 4,229,944 | A | * | 10/1980 | Weiler | 60/740 |
| 4,678,429 | A | * | 7/1987 | Zecman | 431/144 |
| 4,846,670 | A | * | 7/1989 | Pearl et al. | 431/346 |
| 5,271,562 | A | * | 12/1993 | Myers et al. | 239/290 |
| 5,487,659 | A | * | 1/1996 | Eroglu et al. | 431/350 |
| 5,680,766 | A | * | 10/1997 | Joshi et al. | 60/746 |
| 5,836,163 | A | * | 11/1998 | Lockyer et al. | 60/737 |
| 6,276,615 | B1 | * | 8/2001 | Scholz | 239/424 |

(Continued)

FOREIGN PATENT DOCUMENTS

DE 19750329 5/1998

(Continued)

*Primary Examiner* — Kenneth B Rinehart
*Assistant Examiner* — Daniel A Bernstein
(74) *Attorney, Agent, or Firm* — Leydig, Voit & Mayer, Ltd.

(57) ABSTRACT

A lance for a hybrid burner of a combustor of a gas turbine, includes an inner passage for a liquid fuel, an outer passage coaxially enclosing the inner passage for a gaseous fuel, a plurality of star like arranged outer nozzles branching off radially from the outer passage, a plurality of inner nozzles, which branch off radially from the inner passage and which each extend coaxially inside one of the outer nozzles, and a distributor section, which is arranged upstream of the outer nozzles in the outer passage and has a plurality of star like arranged, coaxially extending through-openings for the gaseous fuel. In order to reduce the flow resistance in the gas path of the lance, the through-openings each have an opening width which is larger in the circumferential direction than in the radial direction.

13 Claims, 4 Drawing Sheets

U.S. PATENT DOCUMENTS 6,311,473 B1 * 11/2001 Benjamin et al. ..... 60/776
6,325,618 B1 * 12/2001 Benz et al. ..... 431/187
6,402,059 B1 * 6/2002 Benz et al. ..... 239/422
RE39,425 E * 12/2006 Taylor ..... 431/350
7,267,809 B2 * 9/2007 Ranke et al. ..... 423/449.1
2004/0123784 A1 * 7/2004 Satchell, Jr. ..... 110/261

FOREIGN PATENT DOCUMENTS

DE 19905996 8/2000
JP 58 198612 11/1983

* cited by examiner

HYBRID BURNER LANCE

This application is a continuation of International Patent Application PCT/EP2005/054073, filed on Aug. 18, 2005 and claims priority to German Patent Application DE 10 2004 041 272, filed on Aug. 23, 2004. The entire disclosure of both applications is incorporated by reference herein.

The present invention relates to a lance for a hybrid burner of a combustor of a gas turbine, in particular a gas turbine for a power plant.

BACKGROUND

By means of such a lance, a liquid fuel, for example a suitable oil, and a gaseous fuel, for example natural gas, can be sprayed alternatively or in a cumulative manner into a hybrid burner. The lance is normally supplied with the gaseous fuel via a pipeline in which a gas pressure predetermined by the gas supply system prevails. However, in a multiplicity of applications, e.g. in a combustor having a low-pressure burner and downstream high-pressure burner, this system pressure present in the pipeline is too low in order to be able to spray the gaseous fuel with sufficient pressure difference through the lance into the combustor. Accordingly, it is conventional practice to arrange an additional compressor upstream of the lance in order to raise the gaseous fuel to the requisite pressure level. However, the fitting of such an additional compressor increases the installation costs of the combustor or of the gas turbine equipped with it. Furthermore, the additional compressor, for its operation, requires energy which, in a preferred application of the gas turbine in a power plant for the generation of electricity, reduces the efficiency of the power plant.

SUMMARY OF THE INVENTION

An object of the present invention is to specify an improved embodiment for a lance of the type mentioned at the beginning, which improved embodiment, in particular, enables the hybrid burner equipped with the lance to be operated at a comparatively low pressure in the gaseous fuel.

A further or alternate object of the present invention is to reduce the resistance to flow of the lance by aerodynamic improvements in the gas path of the lance in order thus to reduce the pressure drop which occurs during flow through the lance. In effect, that pressure in the gaseous fuel which is required upstream of the lance can be reduced as a result. An aim in this case is to reduce the resistance to flow in the gas path of the lance if possible to such an extent that the pressure drop remaining permits proper operation of the burner just with the system pressure prevailing in the pipeline. This means that an additional compressor upstream of the lance can be dispensed with.

According to the present invention, the flow resistance in the gas path of the lance is markedly reduced in particular by virtue of the fact that, at a distributor section which is arranged upstream of the outer nozzles in the outer passage and which has a plurality of star like arranged, axially extending through-openings for the gaseous fuel, the through-openings are dimensioned in such a way that they each have an opening width which is larger in the circumferential direction than in the radial direction. Due to this type of construction, that cross section in the distributor section through which flow can occur is considerably increased, which correspondingly reduces its resistance to flow. In this case, the invention makes use of the knowledge that, during flow through the distributor section, an especially pronounced pressure drop is produced inside the lance, so that there is especially high potential there for reducing the resistance to flow.

According to an advantageous embodiment, the outer passage can be defined axially in the region of the outer nozzles by an outer end wall, as a result of which the outer passage is axially closed. At each outer nozzle, an axial recess is then formed in the outer end wall on a side remote from the distributor section. By means of such a recess, the flow around the inner nozzles extending coaxially inside the outer nozzles can take place in a considerably more effective manner, which considerably simplifies the flow of the gaseous fuel from the outer tube into the outer nozzles, in particular on their side remote from the distributor section. Accordingly, the flow resistance is also markedly reduced in the region of the transition between outer tube and outer nozzles. At the same time, in such an embodiment, the homogeneity of the flow through the outer nozzles and thus the quality of the spraying of the gaseous fuel can be improved.

A further reduction in the pressure drop in the gas path of the lance can be realized in another embodiment by virtue of the fact that, at each outer nozzle, a transition from the outer passage to an outer-nozzle passage formed in the interior of the respective outer nozzle is provided with an inlet zone narrowing in the flow direction. Such an inlet zone reduces the flow resistance during the deflection of the gas flow, a factor which likewise reduces the total resistance of the lance.

Further important features and advantages of the lance according to the invention follow from the claims, the drawings and the associated description with reference to the drawings.

BRIEF DESCRIPTION OF THE DRAWINGS

Preferred exemplary embodiments are shown in the drawings and are described in more detail below, the same designations referring to the same or similar or functionally identical components. In the drawings, in each case schematically.

DETAILED DESCRIPTION

Figure 1:
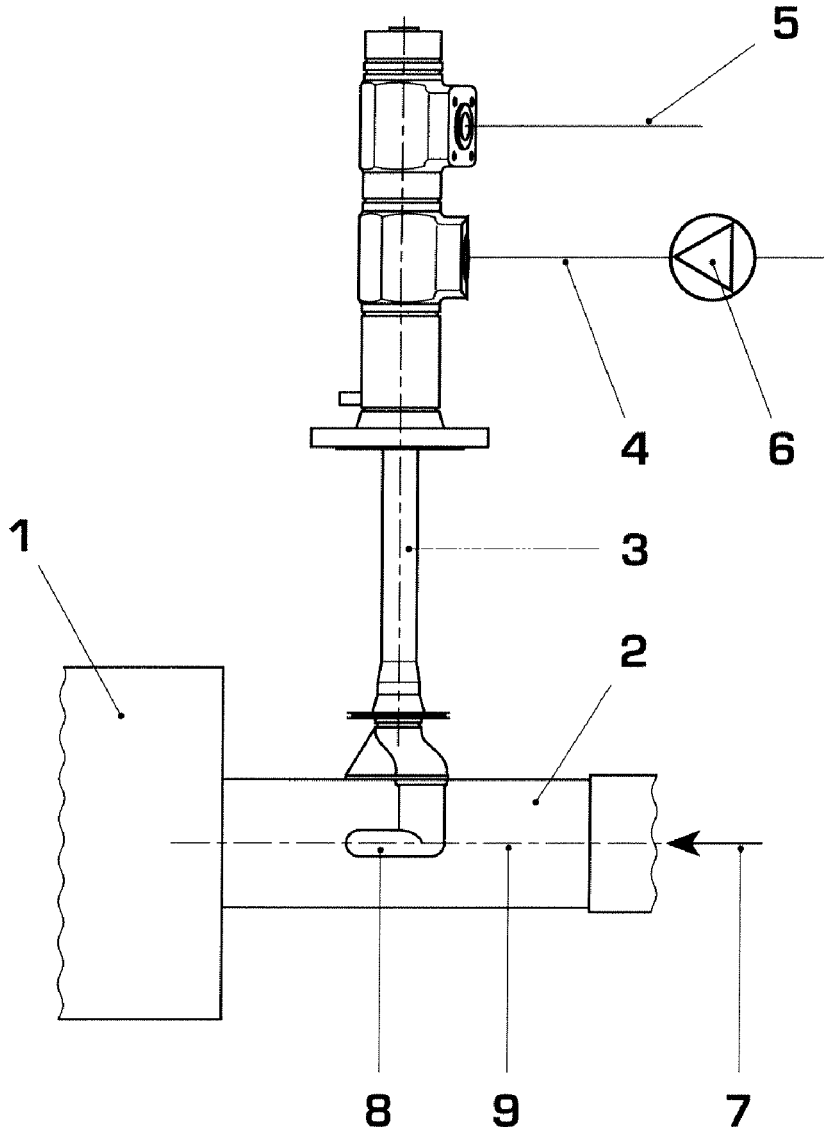
FIG. 1 shows a simplified diagrammatic illustration of a lance according to the invention in the fitted state.

According to FIG. 1, a combustor 1 only partly indicated here comprises at least one hybrid burner 2 which is equipped with a lance 3. The combustor 1 is preferably an integral part of a gas turbine (not shown here), in particular for the generation of electricity inside a power plant.

The hybrid burner 2 can burn both gaseous fuels, such as natural gas for example, and liquid fuels, such as a suitable oil for example. Accordingly, the lance 3 is connected to a liquid-fuel supply line 4 on the one hand and to a gas-fuel supply line 5 on the other hand. A pump 6 is normally arranged in the liquid-fuel supply line 4 in order to be able to pressurize the liquid fuel to the requisite supply pressure. In contrast thereto, the gas-fuel supply line 5 is connected essentially directly to a pipeline (not shown here) which provides the gaseous fuel at a comparatively low pipeline pressure. The configuration of the lance 3 according to the invention enables a compressor in the gas-fuel supply line 5 upstream of the lance 3 to be dispensed with.

Compressed air is fed to the burner 2 from a compressor (not shown) in accordance with the arrow 7. With regard to the flow direction of the air 7, the lance 3 is brought essentially radially up to the burner 2 and has a lance head 8 projecting into the burner 2 and disposed essentially at right angles. With regard to its longitudinal center axis 9, the lance head 8 is therefore oriented parallel to the main flow direction of the fed air 7. The lance head 8 is configured in such a way that, relative to its longitudinal center axis 9, that is to say relative to the main flow direction, prevailing in the burner 2, of the air 7, it sprays the liquid and/or gaseous fuel radially into the burner 2.

The explanations below relate in particular to the lance head 8.

Figure 2:
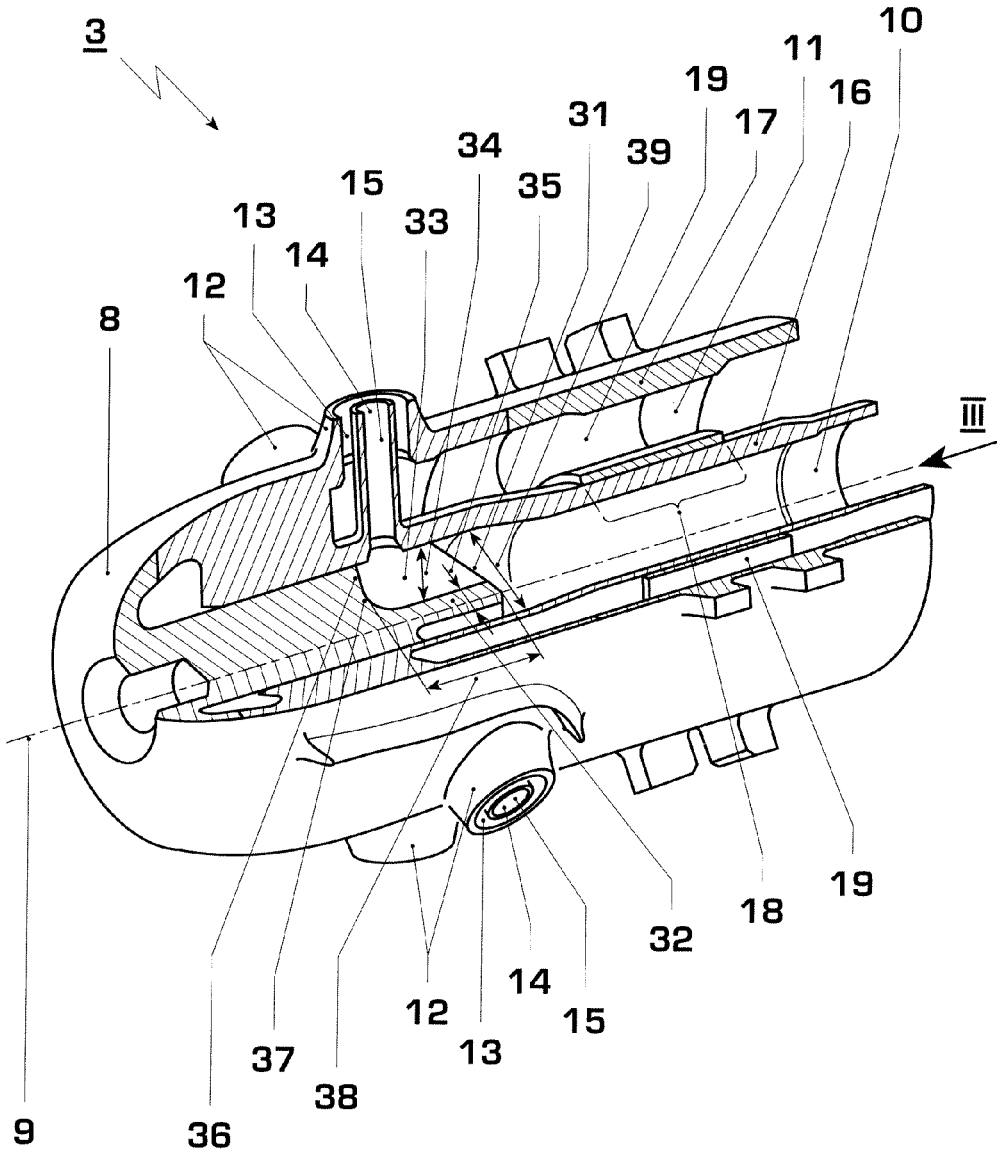
FIG. 2 shows a perspective, partly sectioned view of a head of the lance.
Figure 3:
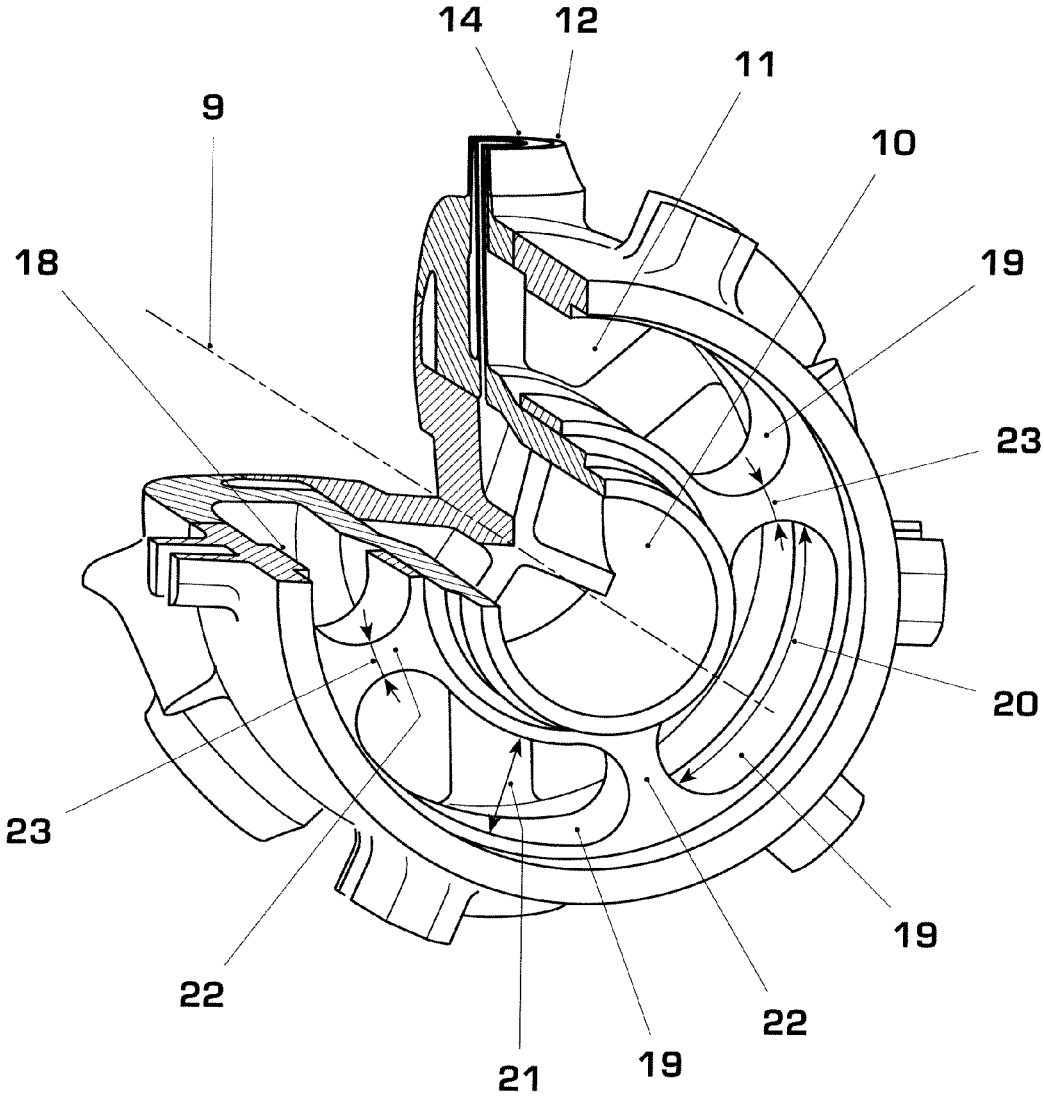
FIG. 3 shows a partly sectioned, perspective view of the lance head according to FIG. 2 in a different direction of view identified by III.

According to FIGS. 2 and 3, the lance 3, in its head 8, contains an inner passage 10 for liquid fuel and an outer passage 11 for gaseous fuel. The two passages 10, 11 are arranged coaxially to one another, so that the outer passage 11 encloses the inner passage 10. Accordingly, the outer passage 11 has an annular cross section, whereas the inner passage 10 has a full cross section. The inner passage 10 and outer passage 11 are separated from one another by an inner tube 16 and are enclosed by an outer tube 17 arranged coaxially thereto.

To spray the gaseous fuel, the lance 3 is provided at its head 8 with a plurality of outer nozzles 12 which are star like arranged relative to the longitudinal center axis 9 and start radially from the outer passage 11. The outer nozzles 12 each contain an outer-nozzle passage 13 which branches off radially from the outer passage 11 and communicates with the latter. Accordingly, the gaseous fuel can be sprayed into the burner 2 via the outer nozzles 12.

In a corresponding manner, the lance 3 is also provided at its head 8 with inner nozzles 14 which are star like arranged relative to the longitudinal center axis 9 and at the same time branch off radially from the inner passage 10. In this case, a respective inner nozzle 14 is arranged coaxially inside an outer nozzle 12, the inner nozzles 14 and outer nozzles 12 each ending approximately flush radially on the outside. Each inner nozzle 14 contains an inner-nozzle passage 15 which communicates with the inner passage 10. Accordingly, the liquid fuel can be sprayed into the burner 2 via the inner nozzles 15.

The coaxial arrangement of the nozzles 12, 14 results in an annular cross section for the outer-nozzle passage 13, whereas the inner-nozzle passage 15 has a full cross section.

Arranged in the outer passage 11 upstream of the outer nozzles 12 is a distributor section 18, which in FIG. 2 is identified by a brace. The distributor section 18 forms an axial section, closed in an annular shape, of the lance 3 or of the lance head 8 and may be designed in particular in one piece with the outer tube 17. The distributor section 18 is therefore arranged in the cross section, through which flow can occur, of the outer passage 11. So that the gaseous fuel can nonetheless reach the outer nozzles 12, the distributor section 18 is provided with a plurality of through-openings 19 which are star like arranged and extend axially through the distributor section 18. Such a distributor section 18 is required in order to be able to ensure a certain pressure difference with respect to the gas path in the event of damage during which the lance head 8, for example, has become leaky due to overheating, so that the flame front cannot drift into the gas path against the gas flow direction or so that an excessive amount of fuel cannot flow into the burner 2 in an uncontrolled manner.

So that the distributor section 18 for the gaseous fuel has as low a resistance to flow as possible, the through-openings 19 are each designed in such a way that they have an opening width which is larger in the circumferential direction than in the radial direction. In FIG. 3, the circumferential opening width oriented in the circumferential direction is marked by an arrow 20, whereas the radial opening width oriented in the radial direction is indicated by an arrow 21. It can clearly be seen that the circumferential opening width 20 is selected to be more than twice as large as the radial opening width 21. In particular, the circumferential opening width 20 is about three to five times larger, preferably about four times larger than the radial opening width 21. The dimensioning selected for the through-openings 19 results in a comparatively low resistance to flow for said through-openings 19, so that the pressure drop which occurs during flow through the distributor section 18 is correspondingly low. Consequently, a comparatively low flow resistance is also obtained for the lance 3.

In the preferred embodiment shown here, the through-openings 19 each extend in the circumferential direction along a segment of an arc of a circle, as a result of which an especially large cross section through which flow can occur can be achieved for the respective through-opening 19. In principle, other cross-sectional geometries may also be used, for example elliptical cross sections.

Without restricting the universality, four through-openings 19 are provided in the embodiment shown here. The individual through-openings 19 are separated from one another in the circumferential direction by webs 22. In this case, the webs 22 extend radially and axially relative to the longitudinal center axis 9. Compared with the through-openings 19, these webs 22 have only a comparatively small cross section. The circumferential opening width 20 of the through-openings 19 is in each case at least three times larger than a wall thickness 23, measured in the circumferential direction, of the webs 22. In particular, the webs 22 are dimensioned in such a way that the circumferential opening width 20 of the through-openings 19 is about four to eight times larger than the wall thickness 23 of the webs 22.

Figure 4:
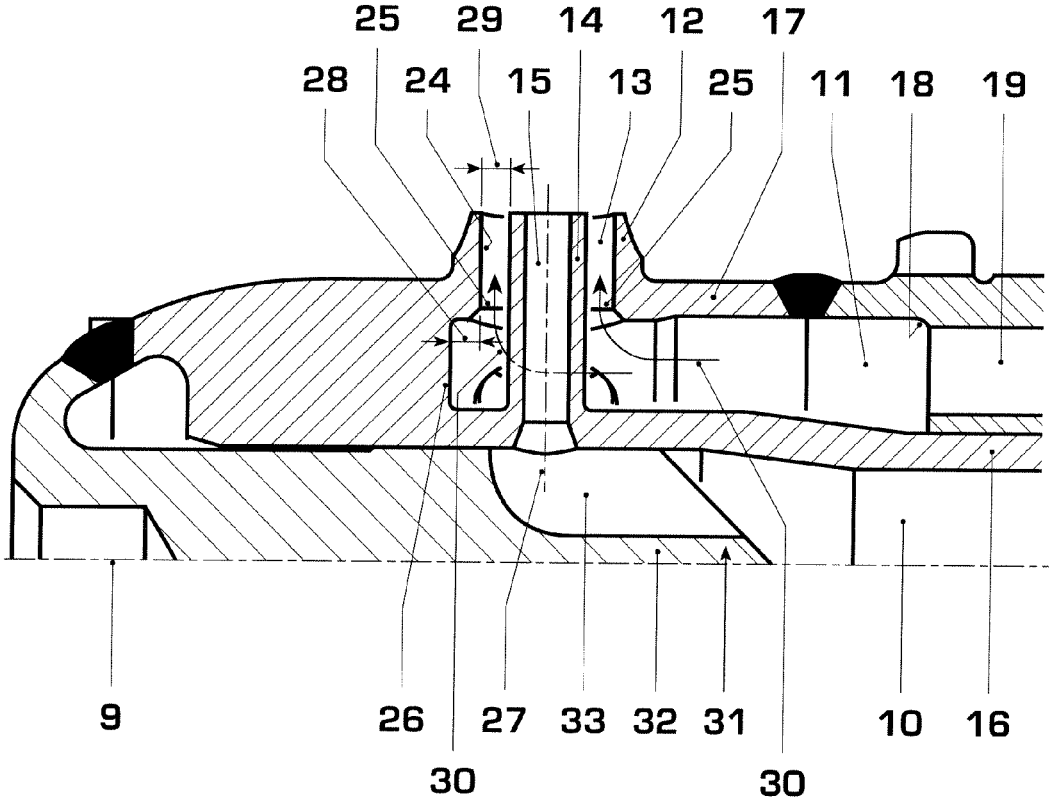
FIG. 4 shows a half longitudinal section of the lance head in a nozzle region.

With reference to FIG. 4, it can be seen especially clearly that the outer passage 11 in the region of the outer nozzles 12 is closed axially by an outer end wall 24. Since the outer nozzles 12 or the outer-nozzle passages 13 are oriented radially relative to the outer passage 11, a relatively pronounced flow deflection occurs at a transition 25 between outer passage 11 and outer-nozzle passage 13, a factor which is indicated in FIG. 4 by arrows. According to an advantageous configuration, in order to reduce the pressure drop accompanying the flow deflection, an axial recess 26 can be cut out in the outer end wall 24 at each outer nozzle 12 on a side remote from the distributor section 18. This recess 26 makes it easier for the gas flow in the inner passage 11 to flow around the respective inner nozzle 14. As a result, the deflection of the gas flow can be improved with the outer nozzle 12 on the side remote from the distributor section 18. This leads to the pressure distribution inside the transition 25 being made more uniform, with the consequence that, firstly, the flow resistance in the region of the transition 25 is reduced and, secondly, the homogeneity of the flow distribution inside the outer-nozzle passage 13 is improved.

As shown here in FIG. 4, the recesses 26 may be provided separately for each outer nozzle 12, a configuration then being preferred in which the recess 26 is designed in the shape of a segment of an arc of a circle relative to a longitudinal center axis 27 of the nozzles 12, 14. As a result, "wake zones" can be reduced and the flow resistance can be reduced. Alternatively, it is also possible in principle to provide a common recess 26 for all outer nozzles 12. Such a common recess 26 then forms an encircling annular groove, closed in the circumferential direction, in the outer end wall 24. Such an embodiment is especially simple to produce.

Especially favorable values for the pressure drop at the transition 25 can be achieved if the dimensioning of the recess 26 is matched to the dimensions of the outer-nozzle passage 13 in a special manner. For example, an embodiment is favorable in which a radial depth 28 measured relative to the longitudinal center axis 27 of the outer nozzle 12 is about two times or at least two times larger than a radial distance 29 between an inner wall (not designated in any more detail) of the outer nozzle 12 and an outer wall (not designated in any more detail) of the inner nozzle 14 arranged therein.

A further measure of reducing the pressure loss inside the lance 3 is seen in aerodynamic optimization of the transition 25. For this purpose, the transition 25 according to FIG. 4 may be provided with an inlet zone 30 which narrows in the flow direction. As a result, the flow resistance at the transition from the outer passage 11 into the respective outer-nozzle passage 13 is reduced. The narrowing of the inlet zone 30 can be achieved by simple beveling. It is likewise possible for the narrowing to be of rounded-off design.

As can be seen from FIGS. 2 to 4, a splitter 31 is expediently arranged in the inner passage 10 in the region of the inner nozzles 14. The splitter 31 comprises a core 32 which extends concentrically inside the inner passage 10. Formed on this core 32 are dividing walls 33 which extend radially and axially and in the process project star like from the core 32 in such a way that they touch the inner tube 16. In this case, the core 32 and the dividing walls 33 are advantageously designed to be swept back in the incident-flow direction toward the longitudinal center axis 9. By means of such a splitter 31, the deflection of the liquid flow in the inner passage 10 to the inner nozzles 14 can be improved.

Especially advantageous, then, is an embodiment which is shown in FIGS. 2 and 3 and in which a distance 34 between the core 32 and the inner tube 16 is at least twice as large as a core diameter 35. In such a type of construction, the inner tube 16 in the region of the splitter 31 need not be widened or need only be widened slightly in order to be able to ensure as constant a cross section of flow as possible up to the inner nozzles 14. The result of this is that the outer passage 11 can have a larger cross section of flow in the region of the outer nozzles 12, so that as constant a cross section of flow as possible can also be achieved in the outer passage 11 up to the outer nozzles 12. This measure therefore also ultimately leads to a reduction in the flow resistance in the gas path of the lance 3.

A further special feature can also be seen from FIGS. 2 and 3, since the core 32 projects axially there from an inner end wall 36 which axially closes the inner passage 10 in the region of the inner nozzles 14. In order to improve the deflection to the inner nozzles 14, a transition 37 from the core 32 to the inner end wall 36 may be designed in the form of a fillet. As a result, it is possible for the splitter 31 to be of axially shorter construction. For example, an axial length 38 which is about the same size as or may even be smaller than an opening cross section 39 of the inner passage 10 in the region of the inner nozzles 14 is preferred for the core 32. This relatively short splitter 31 permits in turn widening in the outer passage 11 and leads there to a reduced flow resistance.

What is claimed is:

1. A lance for a hybrid burner of a combustor of a gas turbine, the lance comprising:

an inner passage for a liquid fuel defining a lance axis, wherein the liquid fuel is disposed in the inner passage;

an outer passage for a gaseous fuel coaxially enclosing the inner passage, wherein the gaseous fuel is disposed in the outer passage;

a plurality of outer nozzles branching off radially from the outer passage;

a plurality of inner nozzles branching off radially from the inner passage, each extending coaxially inside a respective one of the outer nozzles; and a distributor section disposed axially upstream of the outer nozzles with respect to the lance axis in the outer passage and having a plurality of axially extending through-openings for the gaseous fuel, each through-opening having an opening width that is larger in a circumferential direction than in a radial direction, wherein a portion of the outer passage is disposed axially between the distributor section and the outer nozzles so as to effect a pressure difference of the gaseous fuel in the outer passage between an upstream and a downstream side of the distributor.

2. The lance as recited in claim 1, wherein each of the through-openings extend in the circumferential direction along a segment of an arc of a circle.

3. The lance as recited in claim 1, wherein the through-openings are defined in the circumferential direction by radially and axially extending webs, the opening width in the circumferential direction being at least three times larger than a wall thickness of the webs in the circumferential direction.

4. The lance as recited in claim 3, wherein the opening width in the circumferential direction is about four to eight times larger than the wall thickness of the webs in the circumferential direction.

5. The lance as recited in claim 1, wherein the outer passage is axially closed in a region of the outer nozzles by an outer end wall disposed axially downstream of the outer nozzles, and wherein an axial recess is formed in the outer end wall at each outer nozzle on a side remote from the distributor section.

6. The lance as recited in claim 5, wherein the axial recess is formed as a separate recess for each outer nozzle.

7. The lance as recited in claim 6, wherein the axial recess has a shape of a segment of a cylinder coaxially aligned with the outer nozzle.

8. The lance as recited in claim 5, wherein the axial recess is a common recess for all outer nozzles and extends in a closed annular shape in the circumferential direction.

9. The lance as recited in claim 5, wherein the axial recess has a radial depth relative to a longitudinal center axis of the respective outer nozzle that is at least twice as large as a radial distance between an inner wall of the outer nozzle and an outer wall of the inner nozzle.

10. The lance as recited in claim 1, further comprising, at each outer nozzle, a transition from the outer passage to an outer-nozzle passage formed in the interior of the respective outer nozzle, the transition having an inlet zone narrowing in the flow direction.

11. The lance as recited in claim 1, further comprising a splitter disposed in a region of the inner nozzles in the inner passage, the splitter having a core arranged concentrically to the inner passage and radially and axially extending dividing walls projecting from the core up to an inner tube defining the inner passage radially on the outside, and wherein a distance between the core and the inner tube is at least twice as large as a diameter of the core diameter.

12. The lance as recited in claim 11, wherein the core projects axially from an inner end wall axially closing the inner passage in a region of the inner nozzles, and wherein a transition from the core to the inner end wall is in the form of a fillet in longitudinal section.

13. The lance as recited in claim 11, wherein an axial length of the core is not larger than an opening cross section of the inner passage in the region of the inner nozzles.

* * * * *